US010988908B2

(12) United States Patent
Kleibl et al.

(10) Patent No.: US 10,988,908 B2
(45) Date of Patent: Apr. 27, 2021

(54) UNDERGROUND CONSTRUCTION DEVICE

(71) Applicant: ABI Anlagentechnik-Baumaschinen-Industriebedarf Maschinenfabrik und Vertriebsgesellschaft mbH, Niedernberg (DE)

(72) Inventors: Albrecht Kleibl, Grossostheim (DE); Christian Heichel, Niedernberg (DE)

(73) Assignee: ABI Anlagentechnik-Baumaschinen-Industriebedarf Maschinenfabrik und Vertriebsgesellschaft mbH, Niedernberg (DE)

( * ) Notice: Subject to any disclaimer, the term of this patent is extended or adjusted under 35 U.S.C. 154(b) by 0 days.

(21) Appl. No.: 16/739,508

(22) Filed: Jan. 10, 2020

(65) Prior Publication Data

US 2020/0263379 A1 Aug. 20, 2020

(30) Foreign Application Priority Data

Feb. 15, 2019 (EP) ..... 19157538

(51) Int. Cl.
*E02D 7/06* (2006.01)
*F02D 29/04* (2006.01)
(Continued)

(52) U.S. Cl.
CPC ..... *E02D 7/06* (2013.01); *E02D 7/18* (2013.01); *F02D 29/04* (2013.01); *F02D 29/06* (2013.01);
(Continued)

(58) Field of Classification Search
CPC ..... E02D 7/06; E02D 7/18
See application file for complete search history.

(56) References Cited

U.S. PATENT DOCUMENTS 3,828,864 A * 8/1974 Haverkamp ..... E02D 7/18 173/49
4,100,974 A * 7/1978 Pepe ..... E02D 7/18 173/49
(Continued)

FOREIGN PATENT DOCUMENTS

CN 2 644 507 Y 9/2004
DE 10 2013 103 715 A1 10/2014
(Continued)

OTHER PUBLICATIONS

European Search Report dated May 13, 2019 in European Application No. 19157538.0 with English translation of relevant parts.

*Primary Examiner* — Abiy Teka
*Assistant Examiner* — Matthew Wiblin
(74) *Attorney, Agent, or Firm* — Collard & Roe, P.C.

(57) ABSTRACT

An underground construction device includes a hydraulic assembly having an internal combustion engine and a hydraulic pump driven by the internal combustion engine, a work device connected with the hydraulic assembly in a hydraulic circuit for introducing material to be pile-driven into the ground, a clamping apparatus connected with the work device for holding a material to be pile-driven, in clamped manner, which device has a hydraulic clamping cylinder, as well as a controller for opening and closing the hydraulic clamping apparatus. A further hydraulic pump for building up the clamping pressure of the clamping cylinder of the clamping apparatus is provided, which pump is operated by an electric motor. A method operates such an underground construction device.

15 Claims, 4 Drawing Sheets

(51) Int. Cl.

| | |
|---|---|
| ***F15B 15/18*** | (2006.01) |
| ***F15B 11/17*** | (2006.01) |
| ***F02D 29/06*** | (2006.01) |
| ***F15B 3/00*** | (2006.01) |
| ***E02D 7/18*** | (2006.01) |

(52) U.S. Cl.
CPC ..... *F15B 3/00* (2013.01); *F15B 11/17* (2013.01); *F15B 15/18* (2013.01); *F02D 2200/021* (2013.01); *F02D 2200/502* (2013.01); *F15B 2211/20515* (2013.01); *F15B 2211/20523* (2013.01); *F15B 2211/6313* (2013.01); *F15B 2211/6343* (2013.01)

(56) References Cited

U.S. PATENT DOCUMENTS

| | | | | |
|---|---|---|---|---|
| 4,819,740 | A * | 4/1989 | Warrington | E02D 7/00 173/162.1 |
| 7,168,890 | B1 * | 1/2007 | Evarts | E02D 7/18 173/49 |
| 8,070,352 | B2 | 12/2011 | Heichel et al. | |
| 9,249,551 | B1 | 2/2016 | White | |
| 9,835,178 | B2 | 12/2017 | Spohr | |
| 2008/0279638 | A1 * | 11/2008 | Hoess | E02F 9/221 405/274 |
| 2009/0007559 | A1 * | 1/2009 | Dazin | B06B 1/161 60/445 |
| 2015/0083002 | A1 * | 3/2015 | Graf | B30B 15/163 100/35 |
| 2016/0069357 | A1 * | 3/2016 | Spohr | F02D 17/04 60/327 |
| 2018/0038079 | A1 * | 2/2018 | Amano | E02F 9/2239 |
| 2018/0372133 | A1 | 12/2018 | Heichel et al. | |
| 2019/0162211 | A1 * | 5/2019 | Lyytikainen | E02D 7/14 |
| 2020/0224626 | A1 * | 7/2020 | Chen | F02N 11/0825 |

FOREIGN PATENT DOCUMENTS

| | | | |
|---|---|---|---|
| EP | 1 967 292 | A2 | 9/2008 |
| EP | 3 418 451 | A1 | 12/2018 |
| JP | S55-16189 | A | 2/1980 |

* cited by examiner

UNDERGROUND CONSTRUCTION DEVICE

CROSS REFERENCE TO RELATED APPLICATIONS

Applicant claims priority under 35 U.S.C. § 119 of European Application No. 19157538.0 filed Feb. 15, 2019, the disclosure of which is incorporated by reference.

BACKGROUND OF THE INVENTION

1. Field of the Invention

The invention relates to an underground construction device for introduction of pile-driven material into the ground. The invention furthermore relates to a method for operation of such an underground construction device.

2. Description of the Related Art

In construction, underground construction devices are operated for underground construction work in a hydraulic group with different work devices having a hydraulic drive. The hydraulic group regularly consists of a hydraulic pump that is driven by an internal combustion engine, in particular by a supercharged diesel engine, of a work device having a hydraulic drive, in particular a hydraulic motor, as well as of a control or regulation unit. The hydraulic group is operated with a fluid in a hydraulic circuit. The product of the pressure stream and volume stream of the fluid yields the hydraulic power. In order to be able to make the power available that is required for the work device, the internal combustion engine that drives the hydraulic pump is dimensioned to be correspondingly large.

Possible work devices that are used are, in particular, vibrating pile-drivers or vibrators. These devices are used to introduce objects such as steel profiles, for example, into the ground or to pull them out of the ground or also to compact ground material. The ground is excited by means of vibration and thereby reaches what is called a "pseudo-liquid" state. The material to be pile-driven can then be pressed into the construction ground by means of a static top load. Vibrating pile-drivers generally have vibration exciters that act in linear manner, the centrifugal force of which is generated by means of rotating imbalances. The progression of the speed of the linear vibration exciter corresponds to a periodically recurring function, for example a sine function. The vibration exciters are driven using hydraulic rotary drives, which put the shafts on which the imbalances are arranged into rotation. To hold an object to be introduced into the ground, vibrating pile-drivers have a clamping pincer by way of which the vibrations of the vibrator as well as the static top load are transferred to the object being held.

In the case of construction sites that require a vibration-free method, for example near protected historical buildings or near hospitals, hydraulic presses are used as work devices. Such hydro-presses have an arrangement of clamping pincers that are each connected with a hydraulic cylinder and serve to hold an object, in each instance, for example a sheet pile. By activating the hydraulic cylinders, the objects held by the clamping pincers can be pressed into the ground or pulled out of it.

The clamping pincers arranged for holding the objects to be introduced into the ground or to be pulled out of the ground can be activated by means of multiple hydraulic clamping cylinders that are also driven by way of the fluid of the hydraulic group. The clamping pincer has great importance for safety technology. In order to guarantee secure fixation of an object to be introduced into the ground on the work device, a continuous pressure supply to the at least one clamping cylinder of the clamping pincer must be guaranteed so as to ensure the required clamping force. For this reason, in practice, the internal combustion engine continues to be operated during work breaks of the underground construction device, so as to maintain the comparatively low pressure required for the clamping force of the clamping pincers, and this continued operation results in a significant consumption of diesel fuel. To reduce this significant diesel consumption, it is proposed in DE 10 2013 103 715 A1 to recognize breaks in operation on the basis of operating parameters of the work device, and to automatically shut off the internal combustion engine during a break in operation. To ensure the static pressure required for the clamping force of the clamping pincer, applied to the clamping cylinder, this cylinder is supposed to be monitored, and if the pressure drops below a predetermined value, the internal combustion engine is supposed to be automatically turned on. In this regard, the diesel engine is supposed to be shut off only when the clamping pincer is open, in other words is not operating, or if the operation of the clamping pincer is ensured by way of control of the clamping pressure. If the clamping pressure drops as the result of a leakage of the clamping cylinder, the diesel engine is started up and more oil is supplied to the clamping cylinder.

A disadvantage of this proposed solution is that starting and subsequent operation of the internal combustion engine for restoring the pressure required for the clamping force requires a disproportionate amount of energy, i.e. diesel fuel. In order to feed in an additional few milliliters of hydraulic oil, a diesel engine having a coupling power of several hundred kilowatts is started up. More energy is required simply for starting the diesel engine than for feeding in more hydraulic oil. Furthermore, the diesel engine has an idle consumption that is in a very disadvantageous ratio to the power required to feed in additional hydraulic oil. In addition, the diesel engine is burdened by the power loss caused by the large hydraulic pumps connected with it, which are dimensioned for drive of the work device and generally rotate along with the diesel engine.

SUMMARY OF THE INVENTION

The invention wishes to provide a remedy for these disadvantages. The invention is based on the task of making available an underground construction device for which the energy consumption or diesel consumption of the underground construction device is reduced, in particular during breaks in operation. According to the invention, this task is accomplished by means of an underground construction device having a further hydraulic pump for building up the clamping pressure of the clamping cylinder of the clamping apparatus, which pump is operated by an electric motor.

With the invention, an underground construction device is made available, for which the energy consumption or diesel consumption of the underground construction device is reduced, in particular during breaks in operation. Because a further hydraulic pump is provided to build up the clamping pressure of the clamping cylinder of the clamping apparatus, which pump is operated by an electric motor, equalization of drops in pressure, for example due to a leakage of the clamping cylinder, is made possible without starting up the internal combustion engine. The electric motor for operation of the further hydraulic pump can be supplied by way of the rechargeable battery of the internal combustion engine, which is generally present for the required electric starter of the internal combustion engine.

In a further development of the invention, the hydraulic pump driven by the electric motor to build up the clamping pressure is a radial piston pump. As a result, providing the high pressure required for the clamping cylinder is made possible.

In an embodiment of the invention, the hydraulic pump driven by the electric motor to build up the clamping pressure is connected parallel to a hydraulic pump driven by the internal combustion engine to build up the clamping pressure. As a result, a redundant arrangement is achieved, in which the clamping cylinder can be supplied exclusively, in other words even during operation of the work device, by the hydraulic pump operated by the electric motor. Furthermore, maintaining the required clamping pressure is guaranteed using the hydraulic pump driven by the electric motor, even in the event of a failure of the internal combustion engine or of the hydraulic pump driven by it.

In a further embodiment of the invention, a pressure intensifier for increasing the hydraulic pressure made available by the electrically driven hydraulic pump is arranged behind this pump in the flow direction of the hydraulic fluid. As a result, the use of a hydraulic pump having smaller dimensions is made possible.

In a further development of the invention, the electrically driven hydraulic pump is controlled so that a higher pressure is made available—alone or in connection with a pressure intensifier—than the hydraulic pump operated by means of the internal combustion engine for building up the clamping pressure, wherein the maximal clamping pressure is preferably made available only by means of the electrically driven hydraulic pump. As a result, smaller dimensioning of the unit composed of electric motor and hydraulic pump for building up the clamping pressure is made possible.

In an embodiment of the invention, the internal combustion engine and the work device are connected with a controller that is set up for querying at least one operating state value in the event of a deactivated work device, so as to automatically stop the internal combustion engine or to recommend to the operator that the internal combustion engine be stopped, by way of a signal, in particular by way of a display message, if at least one operating state corresponds to an assigned default value. In this regard, it is advantageous if a temperature sensor for measuring the hydraulic fluid temperature or a temperature sensor for measuring the internal combustion engine oil temperature or both are provided, which temperature sensor is connected with the controller, wherein the controller is set up in such a manner that if a limit temperature assigned to a temperature sensor is not reached, stopping of the internal combustion engine or a recommendation for stopping the internal combustion engine does not occur.

In a further embodiment of the invention, a pressure sensor for continuous measurement of the clamping pressure of the clamping apparatus is provided, which sensor is connected with control and regulation equipment that is set up in such a manner that if the clamping pressure drops below a predetermined minimum pressure value, a pressure increase to a predetermined reference pressure value takes place by means of the pump operated by the electric motor. As a result, autarchic pressure regulation by way of the hydraulic pump operated by the electric motor is made possible, without startup of the internal combustion engine being required.

In a further development of the invention, the electric motor is supplied by way of a rechargeable battery, which is connected with a charging apparatus operated by means of the internal combustion engine, wherein a sensor is provided for continuous measurement of the charging state of the rechargeable battery, which sensor is connected with a control device for turning on the internal combustion engine, which device is set up in such a manner that if the charging state of the rechargeable battery drops below a predetermined minimal charging state, automatic startup of the internal combustion engine takes place. As a result, reliable operation of the electric motor for drive of the hydraulic pump operated by it is guaranteed.

The invention is furthermore based on the task of creating a method for operation of such an underground construction device, which method makes possible a reduction in the required energy demand or diesel demand of the carrier device. According to the invention, this task is accomplished by a method wherein the clamping pressure of the clamping cylinder of the clamping apparatus is maintained by a hydraulic pump that is operated by an electric motor, at least when the internal combustion engine is stopped. Because the clamping pressure of the clamping cylinder of the clamping apparatus is maintained, at least when the internal combustion engine is stopped, by means of a hydraulic pump that is operated by an electric motor, starting the internal combustion engine up in the event of a pressure drop of the clamping cylinder of the clamping apparatus is not necessary. It should be noted at this point that in comparison with the energy required to start up the internal combustion engine, the energy demand for additional feed to the clamping cylinder is less by about two powers of ten.

In a further development of the invention, the opening state of the clamping apparatus is queried as an operating state value, wherein the internal combustion engine is stopped only if the collet is closed and only in the event that the pump operated by way of the electric motor is activated. As a result, unintentional opening of the collet is effectively counteracted.

In an embodiment of the invention, the electric motor is operated by way of a rechargeable battery, and the charging state of the rechargeable battery is queried as a further operating state value, wherein the internal combustion engine is stopped, when the collet is closed, only in the event that the charging state of the rechargeable battery lies above a predetermined minimum charge state. As a result, reliable operation of the electric motor is guaranteed when the internal combustion engine is stopped.

In a further development of the invention, a clamping pressure of the clamping apparatus is continuously queried as an operating state, wherein the internal combustion engine is stopped, when the clamping apparatus is closed, if the clamping pressure is greater than a predetermined minimum pressure. Preferably, a hydraulic oil temperature and/or an engine oil temperature of the internal combustion engine and/or an engine coolant temperature of the internal combustion engine is queried as an additional operating state. If a queried temperature lies below an assigned minimum temperature, the internal combustion engine is not shut off.

In an embodiment of the invention, the high pressure required for operation of the clamping cylinder is maintained independent of the operating state of the internal combustion engine, by means of the hydraulic pump, which is operated by an electric motor. As a result, startup of the internal combustion engine for production of the pressure required for operation of the clamping cylinder is avoided.

BRIEF DESCRIPTION OF THE DRAWINGS

Other further developments and embodiments of the invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF PREFERRED EMBODIMENTS

Figure 1:
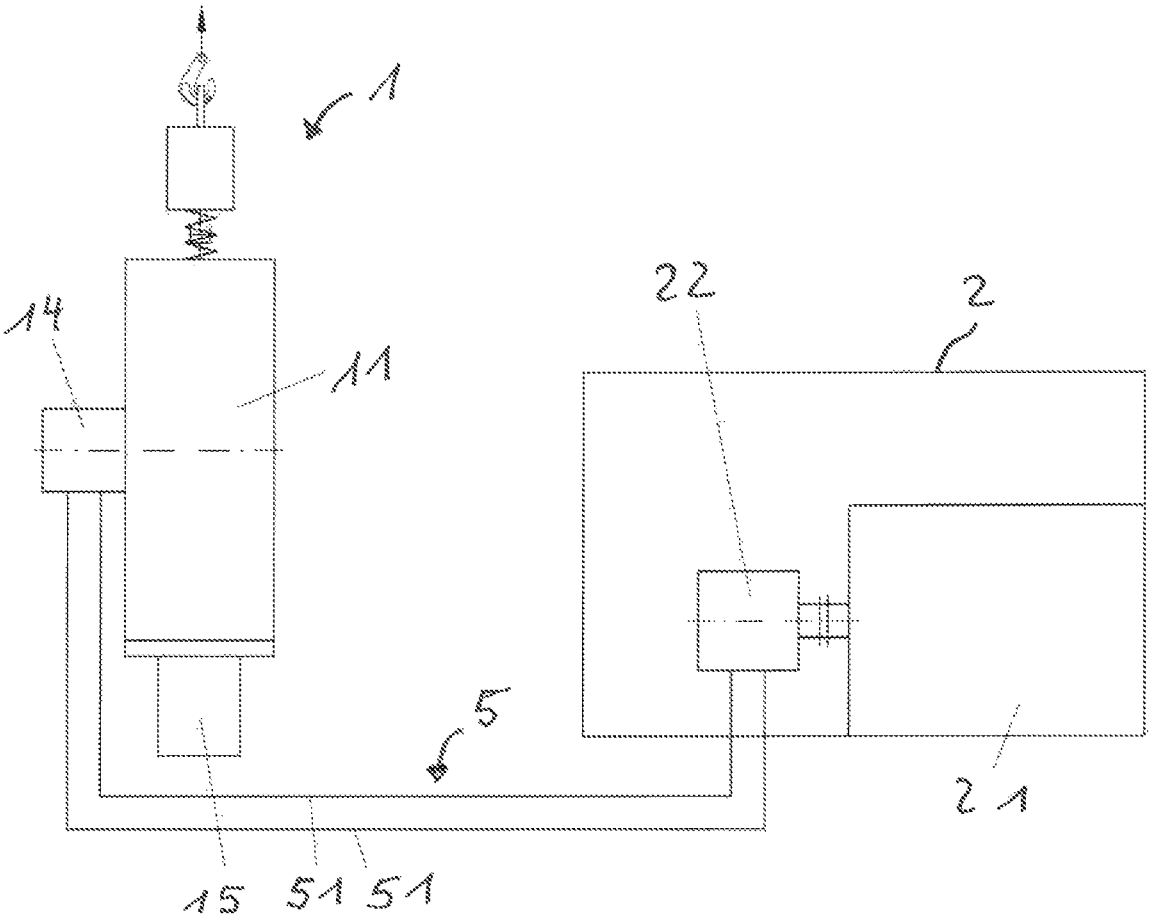
FIG. 1 is a schematic representation of a vibrating pile-driving device with a hydraulic assembly arranged on it.

The underground construction device selected as an exemplary embodiment is configured as a vibrating pile-driving device 1, which is connected with a hydraulic assembly 2 in a hydraulic circuit 5. See FIG. 1. The vibrating pile-driving device 1, in known manner, comprises a vibrator gear mechanism 11 having shafts 12 shown in FIG. 2 arranged parallel to one another. Shafts 12 are provided with imbalances 13 and can be driven by way of a hydraulic motor 14. Such a vibration gear mechanism is described, for example, in EP 1 967 292 A2. A clamping apparatus 15 is arranged on the housing of the vibrator gear mechanism 11, configured in the form of a clamping pincer, which apparatus has a clamping cylinder 16 for clamping material to be pile-driven, in known manner.

The hydraulic assembly 1 comprises an internal combustion engine, in the present case a supercharged diesel engine 21, which drives a hydraulic pump 22. The hydraulic pump 22 is connected with the hydraulic motor 14 of the vibrator gear mechanism 11 of the vibrating pile-driving device 1 by way of hydraulic lines 51 of the hydraulic circuit 5.

Figure 2:
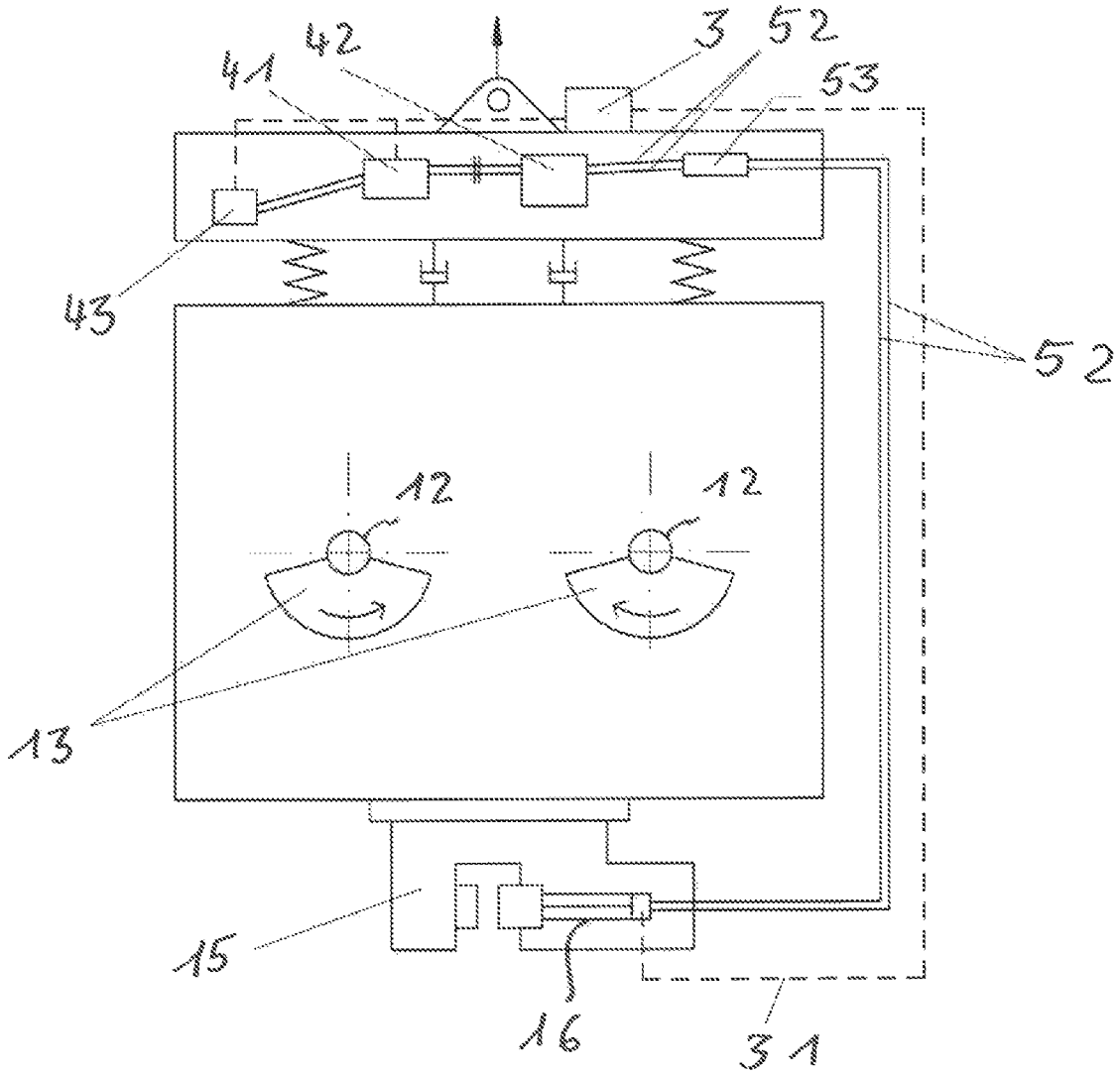
FIG. 2 is a schematic detail representation of the vibrating pile-driving device from FIG. 1.
Figure 3:
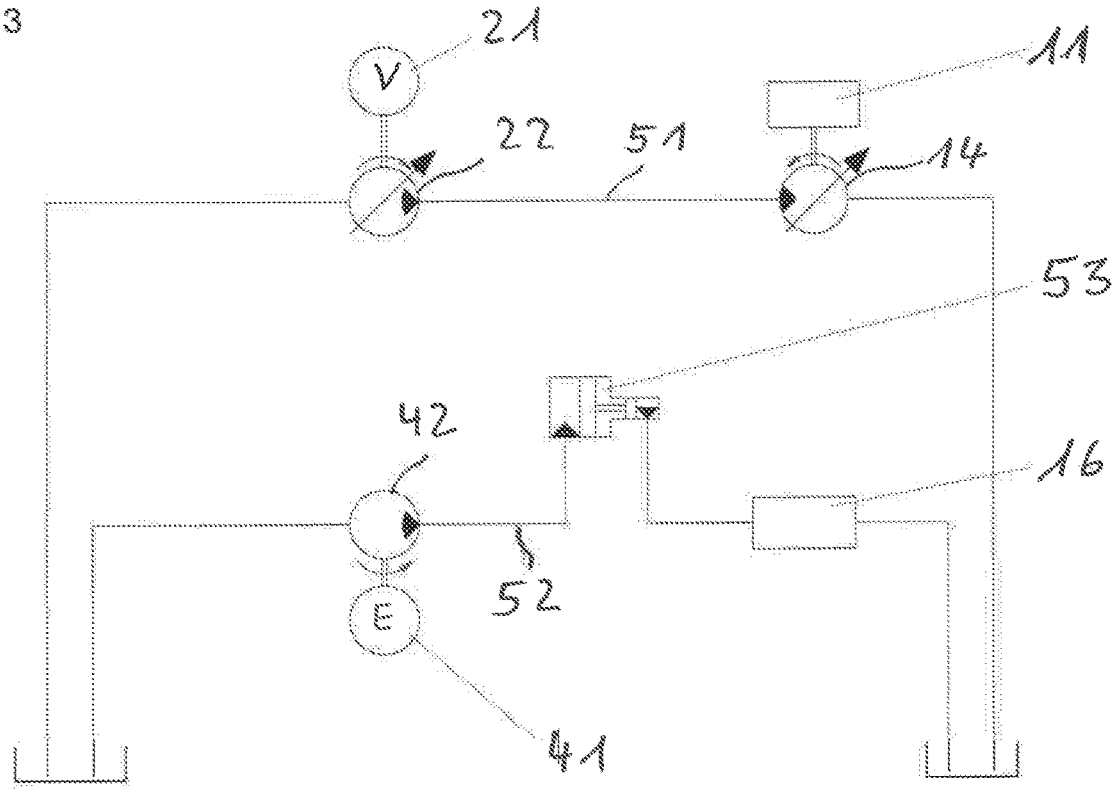
FIG. 3 is a schematic representation of a hydraulic circuit schematic of the vibrating pile-driving device from FIG. 1.

Furthermore, a second hydraulic assembly 4 (see FIG. 4) is arranged on the vibrating pile-driving device 1, which assembly comprises an electric motor 41 that drives a second hydraulic pump 42. To supply voltage, the electric motor 41 is connected with a rechargeable battery 43 as shown in FIG. 2. The hydraulic pump 42 operated by the electric motor 41 is connected with the clamping cylinder 16 of the clamping apparatus 15 by way of hydraulic lines 52. To build up the required clamping pressure, a pressure intensifier 53 is arranged between the hydraulic pump 42 and the clamping cylinder 16, in the hydraulic line 52. To turn on the clamping apparatus 15, a controller 3 is further provided, which is connected with the electric motor 41 and the clamping cylinder 16 by way of control lines 31. Furthermore, the controller 3 is connected with the rechargeable battery 43.

Figure 4:
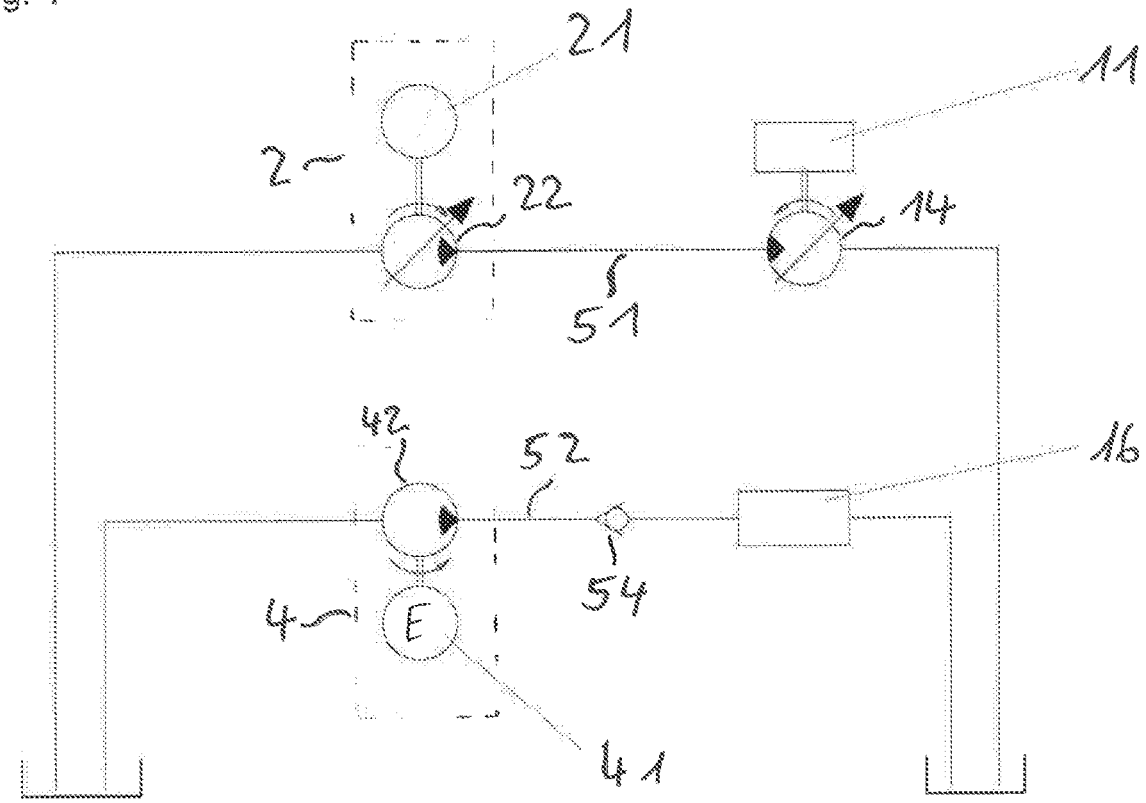
FIG. 4 is a schematic representation of a hydraulic circuit schematic of a vibrating pile-driving device in a further embodiment.

In the present arrangement, completely separate supply to the hydraulic motor 14 of the vibrator gear mechanisms 11 takes place by means of the hydraulic pump 22 driven by the diesel engine 21, on the one hand, as well as supply to the clamping cylinder 16 of the clamping apparatus 15 by way of the hydraulic pump 42 driven by the electric motor 41, on the other hand. In the case of configuration of the hydraulic pump 42 as a high-pressure pump, for example as a radial piston pump, the hydraulic pressure intensifier can be eliminated, as is shown in FIG. 4. Here, only a kickback valve 54 is arranged between hydraulic pump 42 and clamping cylinder 16.

Figure 5:
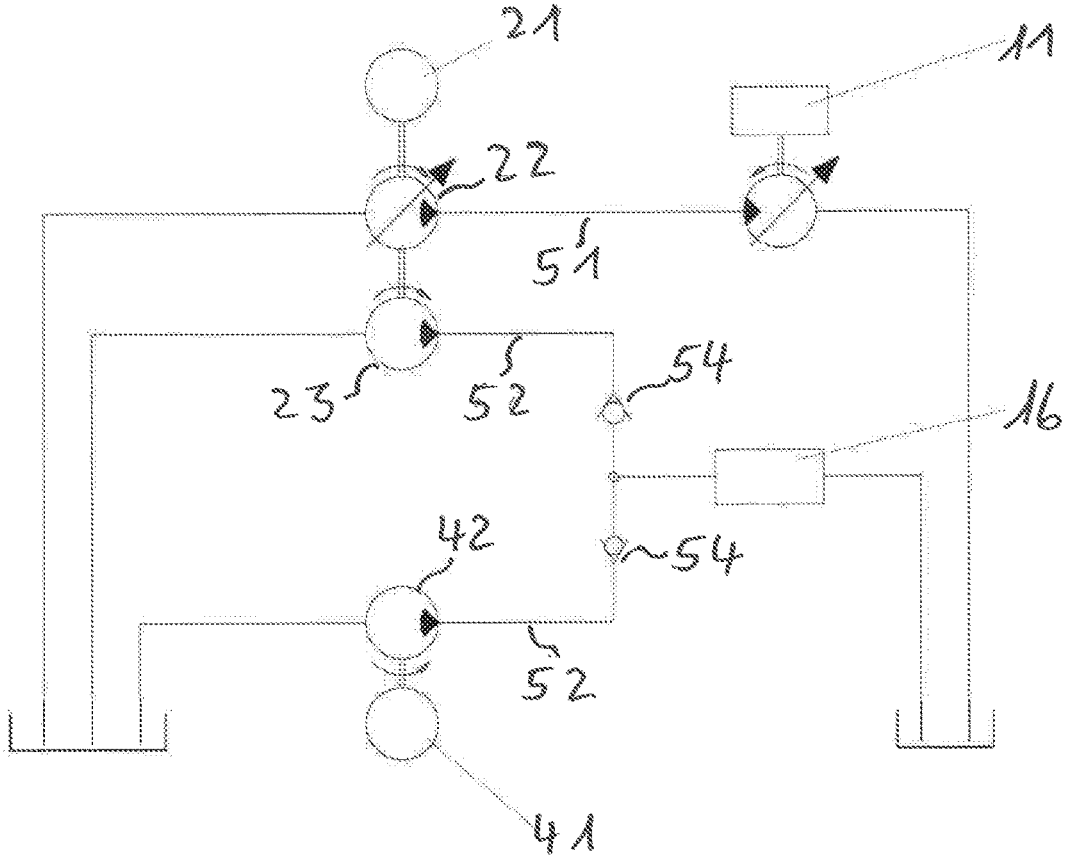
FIG. 5 is a schematic representation of a hydraulic circuit schematic of a vibrating pile-driving device in a third embodiment.

In the exemplary embodiment according to FIG. 5, two hydraulic pumps 22, 23 are arranged in the first hydraulic assembly 2, which pumps are driven by the diesel engine 21. The additional hydraulic pump 23 is connected with the clamping cylinder 16 of the clamping apparatus 15 of the vibrating pile-driving device 1 by way of a kickback valve 54. At the same time, the hydraulic pump 42 driven by the electric motor 41 is also connected with this clamping cylinder 16 by way of a kickback valve 54. In this configuration, the possibility exists of filling the clamping cylinder 16 in conventional manner, using the further hydraulic pump 23 driven by the diesel engine 21, and building up the higher clamping pressure using the hydraulic pump 42, driven by the electric motor 41, once the pressure that can be implemented with this hydraulic pump 23 has been reached.

Figure 6:
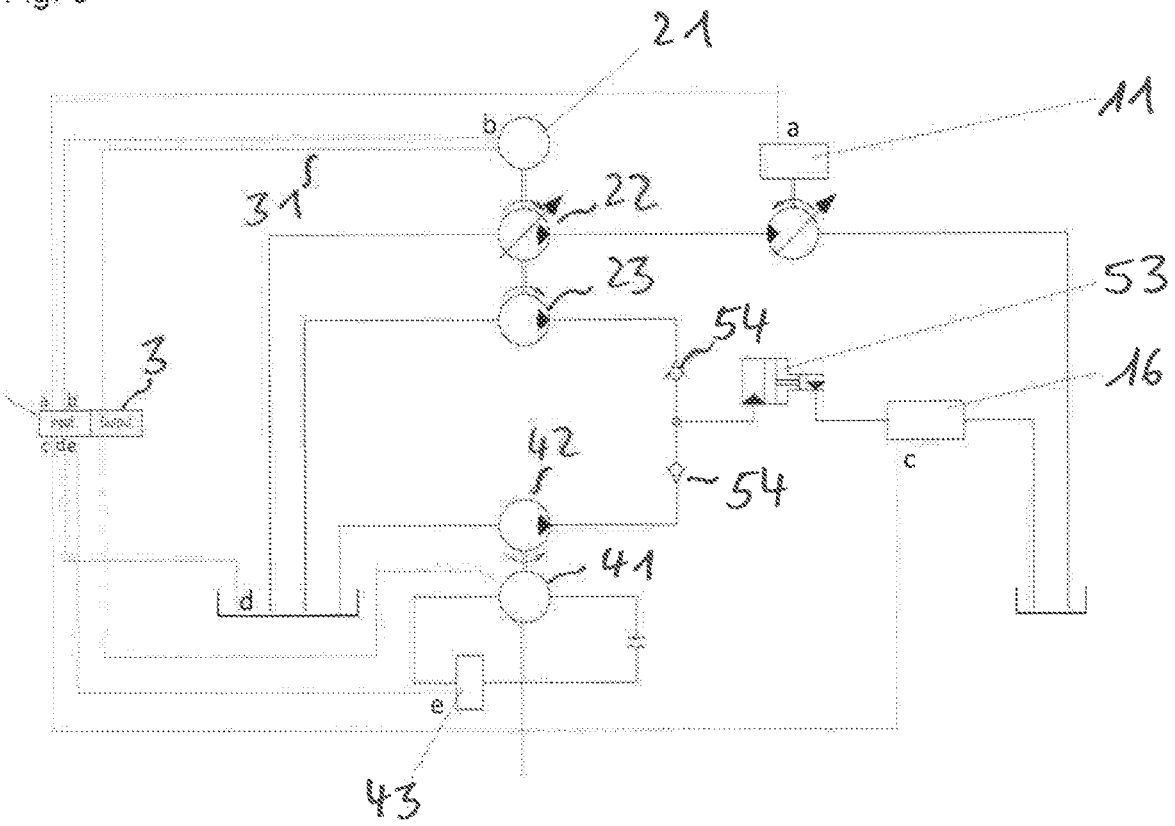
FIG. 6 is a schematic representation of the hydraulic circuit schematic of a vibrating pile-driving device in a fourth embodiment.

In the exemplary embodiment according to FIG. 6, the arrangement described above, according to FIG. 5, was supplemented with a hydraulic pressure intensifier 53, which is arranged to precede the clamping cylinder 16 in the flow direction of the hydraulic fluid, whereby smaller dimensioning of the further hydraulic pump 23 of the first hydraulic assembly 2 and also of the hydraulic pump 42 of the second hydraulic assembly 4 is made possible. Furthermore, the electrical supply to the electric motor 41 is represented by way of a rechargeable battery 43 in an electrical circuit. The controller 3 is configured in expanded form and is connected, at its inputs, with sensors for detection of the vibrator amplitude (a), of the engine oil temperature of the diesel engine (b), of the clamping pressure of the clamping cylinder (c), of the temperature of the hydraulic oil (d), as well as of the charging state of the rechargeable battery (e). Turning on the diesel engine 21 of the hydraulic assembly 2 as well as of the electric motor 41 of the hydraulic assembly 4 takes place by way of the controller 3, as a function of the signals of these sensors. If, for example, the engine is cold in the case of a low outside temperature (corresponding to the engine oil temperature reported by the sensor b) and the charging state of the rechargeable battery 43 is low (corresponding to the charging state reported by the sensor e), the diesel engine 21 is not shut off even during a break in operation. If, in contrast, sensor a, for example, reports a vibrator amplitude of zero, sensor b reports a sufficient engine oil temperature, sensor c reports a sufficient clamping pressure, sensor d reports a sufficient temperature of the hydraulic oil, and sensor e reports a sufficient charging state of the rechargeable battery 43, then the controller 3 either brings about automatic shutoff of the diesel engine 21, or the operator is given an optical and/or acoustical signal that the diesel engine 21 can be shut off.

Although only a few embodiments of the present invention have been shown and described, it is to be understood that many changes and modifications may be made thereunto without departing from the spirit and scope of the invention.

What is claimed is:

1. An underground construction device comprising:

(a) a hydraulic assembly having an internal combustion engine and a first hydraulic pump driven by the internal combustion engine;

(b) a work device configured as a vibrating pile-driving device and connected with the hydraulic assembly in a hydraulic circuit for introducing material to be pile-driven into the ground, wherein the vibrating pile-driving device comprises a vibrator gear mechanism having a hydraulic motor and shafts arranged parallel to each other and provided with imbalances driven by way of the hydraulic motor;

(c) a clamping apparatus configured as a clamping pincer comprising a hydraulic clamping cylinder, wherein the clamping pincer is connected with the work device and configured to hold the material to be pile-driven in a clamped manner;

(d) a controller for opening and closing the hydraulic clamping apparatus;

(e) a second hydraulic pump for building up clamping pressure of the clamping cylinder of the clamping apparatus;

(f) an electric motor operating the second hydraulic pump; and (f) a pressure intensifier arranged to precede the second hydraulic pump in a flow direction of hydraulic fluid for increasing the hydraulic pressure made available by the electrically driven second hydraulic pump;

wherein the second hydraulic pump is configured to maintain the clamping pressure of the clamping cylinder at least when the internal combustion engine is stopped; and wherein the second hydraulic pump driven by the electric motor for building up the clamping pressure is connected in parallel with a third hydraulic pump driven by the internal combustion engine for building up the clamping pressure.

2. The underground construction device according to claim 1, wherein the second hydraulic pump driven by the electric motor for building up the clamping pressure is a radial piston pump.

3. The underground construction device according to claim 1, wherein the electrically driven second hydraulic pump is controlled to make a higher pressure available than the third hydraulic pump operated by the internal combustion engine to build up the clamping pressure.

4. The underground construction device according to claim 3, wherein a maximal clamping pressure is made available only by the electrically driven second hydraulic pump.

5. The underground construction device according to claim 1, wherein the internal combustion engine and the work device are connected with the controller that is set up for querying at least one operating state value in a case of a deactivated work device, and for automatically stopping the internal combustion engine or recommending to an operator that the internal combustion engine be stopped, by way of a signal if the at least one operating state value corresponds to an assigned default value.

6. The underground construction device according to claim 5, wherein the signal comprises a display message.

7. The underground construction device according to claim 5, further comprising a temperature sensor for measuring at least one of a hydraulic fluid temperature and an internal combustion engine oil temperature, wherein the temperature sensor is connected with the controller, wherein the controller is set up in such a manner that if a limit temperature assigned to the temperature sensor is not reached, the stopping of the internal combustion engine or the sending the recommendation for stopping of the internal combustion engine does not take place.

8. The underground construction device according to claim 1, further comprising a pressure sensor connected with the controller for continuous measurement of the clamping pressure of the clamping apparatus, wherein the controller is set up in such a manner that if the clamping pressure drops below a predetermined minimum pressure value, a pressure increase by the second hydraulic pump operated by the electric motor to a predetermined reference pressure value takes place.

9. The underground construction device according to claim 1, further comprising:

a rechargeable battery;

a charging apparatus connected with the rechargeable battery and operated by the internal combustion engine; and a sensor connected with the controller for continuous measurement of a charging state of the rechargeable battery;

wherein the electric motor is supplied by way of the rechargeable battery;

wherein the controller is configured for turning on the internal combustion engine and is set up in such a manner that if a predetermined minimal charging state of the rechargeable battery is not reached, automatic starting of the internal combustion engine takes place.

10. A method for operation of an underground construction device comprising a hydraulic assembly having an internal combustion engine and a first hydraulic pump driven by the internal combustion engine, a work device configured as a vibrating pile-driving device and connected with the hydraulic assembly in a hydraulic circuit for introducing material to be pile-driven into the ground, wherein the vibrating pile-driving device comprises a vibrator gear mechanism having a hydraulic motor and shafts arranged parallel to each other and provided with imbalances driven by way of the hydraulic motor, a clamping apparatus configured as a clamping pincer comprising a hydraulic clamping cylinder, wherein the clamping pincer is connected with the work device and configured to hold the material to be pile-driven in a clamped manner, a controller for opening and closing the hydraulic clamping apparatus, a second hydraulic pump for building up clamping pressure of the clamping cylinder of the clamping apparatus, and an electric motor operating the second hydraulic pump, the method comprising:

(a) querying by the controller at least one operating state value during a break in operation when the work device is deactivated;

(b) automatically stopping the internal combustion engine or sending a recommendation to an operator by the controller by way of a signal that the internal combustion engine be stopped if the at least one operating state value corresponds to a default value; and (c) maintaining the clamping pressure of the clamping cylinder of the clamping apparatus by the second hydraulic pump operated by the electric motor at least when the internal combustion engine is stopped;

wherein the at least one operating state value comprises a first operating state value, wherein an opening state of the clamping apparatus is queried as the first operating state value, wherein the internal combustion engine is stopped when the clamping apparatus is closed only when the second hydraulic pump operated by way of the electric motor is activated.

11. The method according to claim 10, wherein the signal comprises a display message.

12. The method according to claim 10, wherein the at least one operating value further comprises a second operating state value, wherein the electric motor is operated by way of a rechargeable battery, and wherein a charging state of the rechargeable battery is queried as the second operating state value, wherein the internal combustion engine is only stopped, when the clamping apparatus is closed, if the charging state of the rechargeable battery lies above a predetermined minimum charging state.

13. The method according to claim 10, wherein the clamping pressure of the clamping apparatus is continuously queried as the at least one operating state value, wherein the internal combustion engine is stopped if, when the clamping apparatus is closed, the clamping pressure is greater than a predetermined minimum pressure.

14. The method according to claim 13, wherein at least one of the hydraulic oil temperature, the engine oil temperature of the internal combustion engine, and an engine coolant temperature of the internal combustion engine is queried as an additional operating state value, wherein the internal combustion engine is not shut off if a queried temperature lies below an assigned minimum temperature.

15. The method according to claim 13, wherein a high pressure required for operation of the clamping cylinder is maintained independent of an operating state of the internal combustion engine by the second hydraulic pump operated by the electric motor.

* * * * *